US007154033B2

(12) United States Patent
Mutou

(10) Patent No.: US 7,154,033 B2
(45) Date of Patent: Dec. 26, 2006

(54) KEYBOARD FOR MUSICAL INSTRUMENT

(75) Inventor: Noritaka Mutou, Tokyo (JP)

(73) Assignee: Tokyo Yusyo Co. Ltd., Tokyo (JP)

( * ) Notice: Subject to any disclaimer, the term of this patent is extended or adjusted under 35 U.S.C. 154(b) by 84 days.

(21) Appl. No.: 11/017,437

(22) Filed: Dec. 20, 2004

(65) Prior Publication Data

US 2005/0098026 A1 May 12, 2005

Related U.S. Application Data

(62) Division of application No. 10/296,675, filed on Nov. 26, 2002, now abandoned.

(30) Foreign Application Priority Data

Aug. 28, 2000 (JP) ..... 2000-257346

(51) Int. Cl.
*G10D 13/02* (2006.01)

(52) U.S. Cl. ..... 84/423 R

(58) Field of Classification Search ..... 84/423 R, 84/429, 428, 433, 451, 719, 744, 730
See application file for complete search history.

(56) References Cited

U.S. PATENT DOCUMENTS 5,107,262 A * 4/1992 Cadoz et al. ..... 341/22
2005/0087061 A1* 4/2005 Sim et al. ..... 84/719

FOREIGN PATENT DOCUMENTS

JP 7219520 * 8/1985 ..... 84/174

* cited by examiner

*Primary Examiner*—Kimberly Lockett
(74) *Attorney, Agent, or Firm*—Chapman and Cutler LLP

(57) ABSTRACT

An extremely easy-to-play keyboard for musical instrument capable of forming any keyboard rows such as a semitone arrangement to a diatessaron arrangement and a chord arrangement with one keyboard substrate, wherein the keyboard substrate is formed so that the keyboard is formed by disposing, parallel with each other, a large number of key substrates (1) extending in the longitudinal direction of the keyboard with a difference of semitone, installing a plurality of key top mounting parts (5) on each key substrate (1) in the longitudinal direction, and installing the key tops (4) on any key top mounting parts, or by combining various types of keyboard rows with each other, or disposing the keys positioned adjacent laterally to each other in all or a part of the keyboard rows with a difference of minor third and those positioned adjacent longitudinally to each other with a difference of whole tone in the direction from the front side to the right rear side.

2 Claims, 11 Drawing Sheets

6
7
7f
7e
7d
7c
7b
7a
8
8a
A
11
C
C#
D
D#
E
F
F#
G
G#
A
A#
B
C
C#
D
D#
E
F
F#
G
G#
A
A#
B
C
C#
D
D#
E
F
F#
G
G#
A
A#
B

KEYBOARD FOR MUSICAL INSTRUMENT

TECHNICAL FIELD

The present invention relates to a keyboard for musical instrument, for use in pianos, synthesizers or other keyboard instruments.

BACKGROUND ART

The applicant previously proposed a keyboard having a plurality of whole-tone arrangement keyboard rows which are disposed in a staggered manner (Japanese Utility Model Laid-open Pub. No. Sho63-43196).

The above conventional keyboard suffers from a deficiency of being unsuited to glissando although it allows tunes in any key scale to be played with the same fingering as in C major, due to its keyboard configuration in which are staggered the plurality of whole-tone arrangement keyboard rows.

When fingers slide laterally, a series of consecutive tones are played with a difference of whole tone. On the contrary, to obtain a series of consecutive tones with a difference of semitone, the fingers are diagonally slid from the rear keyboard row toward the front keyboard row. In this case, if five keyboard rows are present, the series of consecutive tones contains only five tones, which means that the number of tones contained in the series of consecutive tones becomes equal to the number of keyboard rows.

In the event of playing a piece of music with the keyboard having a plurality of whole-tone arrangement keyboard rows which are disposed in a staggered manner, players familiar with an ordinary keyboard composed of white keys and black keys in major scale arrangement (hereinafter referred to simply as "ordinary keyboard") may be difficult to handle due to its largely different fingering from the case of playing with the ordinary keyboard.

DISCLOSURE OF THE INVENTION

The present invention provides a keyboard substrate comprising a multiplicity of key substrates extending in the front-to-rear direction of a keyboard, the multiplicity of key substrates being juxtaposed with a difference of semitone; a plurality of key top mounting portions provided in the front-to-rear direction on each of the key substrates; and a key top mounted on any key top mounting portion to thereby configure the keyboard (claim 1).

The key substrate is preferably supported on its front end (claim 2). When the key substrate has a greater length, if it is supported only on its rear end, the key substrate will undergo extremely large vertical movements at the front end thereof, making the performance difficult. Thus, the key substrate is preferably divided longitudinally into two parts such that the rear key substrate part is supported on its rear end and that the front key substrate part is supported on its front end.

The thus configured key substrate is used and mounted at its any position with a key top so that a keyboard having a variety of arrangements is obtained.

Claims 3 to 5 define the inventions related to the arrangement of the keyboard.

The invention of claim 3 provides a keyboard for musical instruments having a plurality of keyboard rows, the keyboard comprising a semitone arrangement keyboard section situated at the rear of the keyboard; and a whole-tone arrangement keyboard section situated at the front of the keyboard; the whole-tone arrangement keyboard section including a plurality of whole-tone arrangement keyboard rows in each of which laterally adjacent keys generate tones with a difference of whole tone, the plurality of whole-tone arrangement keyboard rows being staggered such that front-to-rear adjacent keys generate tones with a difference of semitone, wherein each key making up a rearmost whole-tone arrangement keyboard row generates the same tone as generated by a key in opposition thereto of the semitone arrangement keyboard section.

In the above, preferably, the semitone arrangement keyboard section includes rectangular key tops, with key tops in opposition to key tops of the whole-tone arrangement keyboard section being each formed with a raised portion which has substantially the same width in the longitudinal direction, with key tops out of opposition to key tops of the whole-tone arrangement keyboard section being each formed with a raised portion whose extremity is enlarged (claim 4).

The invention of claim 5 provides a keyboard for musical instruments having a plurality of keyboard rows, herein laterally adjacent keys in all or part of the plurality of keyboard rows are disposed to have a difference of minor third, with front-to-rear adjacent keys in all or part of the plurality of keyboard rows being disposed to have a difference of whole tone from front toward diagonally right rear.

According to this invention, it is possible to play with substantially the same fingering as in the ordinary keyboard composed of white keys and black keys.

The invention of claim 5 may be applied to all or part of the keyboard rows. In the event of partial application, the remaining keyboard row(s) may have any configuration selected from a group consisting of semitone arrangement, whole-tone arrangement (major-second arrangement), major-third arrangement, diatessaron arrangement, any chord rows and ordinary keyboard rows.

The invention of claim 6 provides keys disposed in an arc in plan. In this invention, the distance between adjacent key substrates becomes shorter at the side closer to the player, and hence if the key tops are disposed at intervals of the order of difference of whole tone, the key tops may become extremely small, possibly making the performance hard. Such a case, the key tops are disposed preferably at intervals of the order of minor third, major third or diatessaron as in the invention of claim 5.

In the event of applying the keyboard of this invention to electronic instruments, the rod-shaped key substrates need not necessarily be used. For example, the key can be a flat switch (touch panel switch) which goes active in response to a touch of the finger. A single key may be correlated with a plurality of tones with a difference of octaves so that the plurality of (e.g., three) tones with a difference of octaves can simultaneously be played by operating the single key.

In the invention of claim 1, the arrangement of the key tops can freely be selected due to the provision of a plurality of key top mounting portions on each of the key substrates which are juxtaposed with a difference of semitone. It is thus possible to acquire a variety of keyboards having different key top arrangements by use of the same key board substrate. These key substrates can be adapted to all keyboard rows, including semitone, major scale (ordinary arrangement), major second, minor third, major third, diatessaron and any chord rows. It is at user's option which arrangement is to be employed or which arrangements are to be combined together in order to mount the key tops.

The invention of claim 2 allows key operations to conform to the human engineering by supporting the key substrates on their front ends (at player's side).

More specifically, of fingers, the thumb and the little finger are short, but the forefinger, the middle finger and the third finger are long. The keys are often struck around the wrist, and as is apparent from the lever's principle, the closer to the wrist, the smaller the movement becomes, whereas the farther from the wrist, the larger the movement becomes. The lengths of the fingers being as described above, the extremities of the thumb and the little finger have smaller movements than the extremities of the forefinger, the middle finger and the third finger.

In the ordinary keyboard, nevertheless, the key substrates are supported at their rear ends, so that the keys have larger movements at their front end side. Thus the short thumb and little finger having smaller movements are required to move to a larger extent than the long forefinger, etc., having larger movements. As a result, the tones played by the little finger originally having a small power are apt to become even weaker, which tends toward a performance lacking the balance of tones.

However, by supporting the key substrates on their front ends, the movements of the fingers can correspond to the key movements, so that it is possible to play with natural movements of the fingers and to play smoothly with an apparently graceful style.

The invention of claim 3 disposes the semitone arrangement keyboard section at the rear of the keyboard, with the result that a series of consecutive tones with a difference of semitone can be played by sliding the fingers in this semitone arrangement keyboard section. A series of consecutive tones with a difference of whole tone can be played by laterally sliding the fingers in the whole-tone arrangement keyboard section. Then, the fingers may be slid in the semitone arrangement keyboard section and thereafter migrated to the whole-tone arrangement keyboard section, in which the fingers are slid diagonally forward so that a series of consecutive tones can be played with a difference of semitone.

In the invention of claim 4, longitudinally extending raised portions prevent the fingers from migrating to the whole-tone arrangement keyboard section, and only the raised portions having enlarged extremities permit the migration of fingers to the whole-tone arrangement keyboard section. Thus, when the fingers are slid from the semitone difference keyboard rows diagonally forward, the fingers can move smoothly to the whole-tone arrangement keyboard section key tops corresponding to the tones with a difference of semitone.

In the invention of claim 5, the keyboard rows are configured with a difference of minor third such that the front-to-rear adjacent keys have a difference of whole tone from front diagonally right rearward, so that the player can play tunes with the fingering similar to that in the ordinary keyboard. Since a reduced width accommodates the keys corresponding to tones across one octave, it is possible even for the child or woman with small hands to play a high range of chord.

In the invention of claim 6, the keyboard is arcuate such that keyboard rows closer to the player have a smaller pitch between the adjacent key tops and that keyboard rows farther from the player have a larger pitch between the adjacent key tops. Thus, by selecting the keyboard rows used so as to conform to the lengths of the player's fingers, it is possible to use the keyboard rows with pitches suited to the player, and to strike a wide range of chord, as compared with the linear arrangement keyboard, due to the reduced rectilinear distance between the adjacent key tops.

In this invention, the same tone is allocated to a plurality of keys. Thus, in order to specify the positions of keys to which is allocated the same tone as allocated to the struck key, the keys may emit light to which is allocated the same tone as the struck tone. The light may be emitted only from completely the same tones inclusive of the interval, or from the same tones including tones with different intervals (difference of an octave). Light emitting means can be, as appropriate, a miniature bulb, alight-emitting diode, a liquid crystal, an optical fiber, etc. The light emission color may be different from tone name to tone name, for identification.

DESCRIPTION OF REFERENCE NUMERALS

Figure 1:
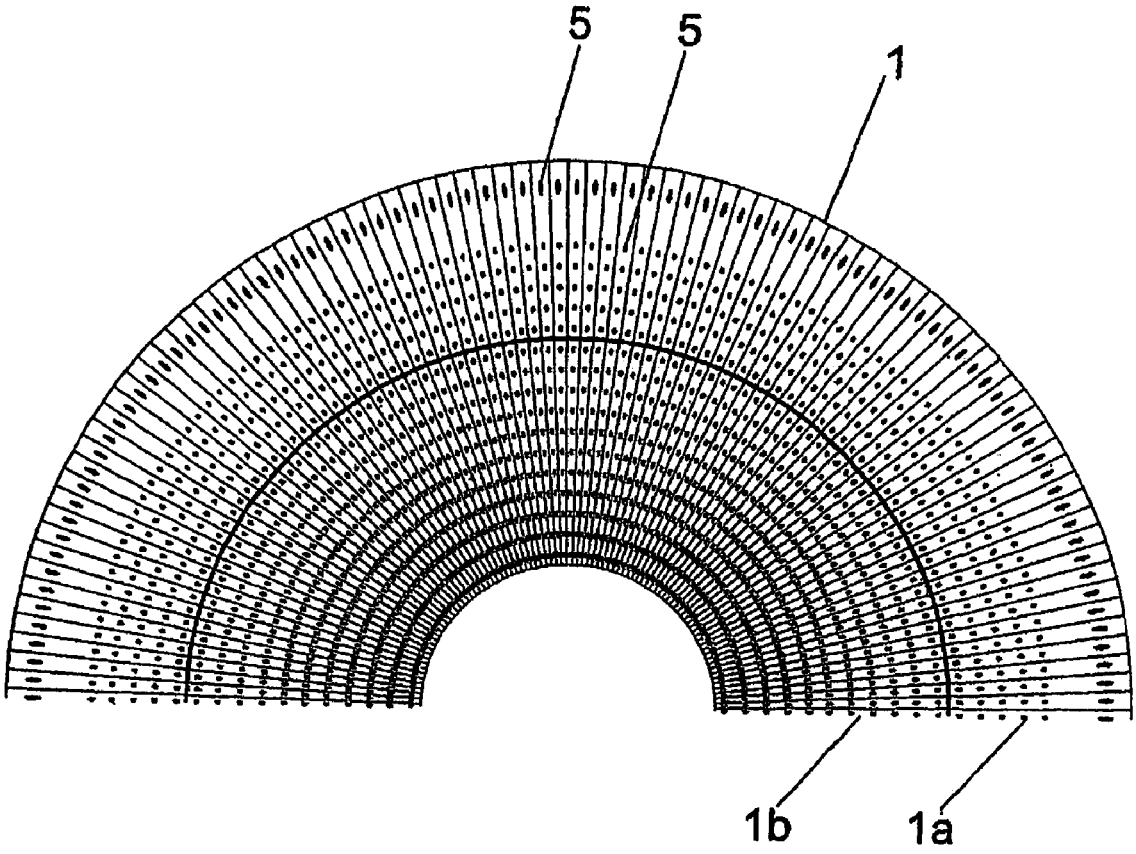
FIG. 1 is a top plan view of an embodiment 1 in accordance with the present invention.

A keyboard
1 key substrate
1*a* rear key substrate
1*b* front key substrate
2 rear end of key substrate
3 front end of key substrate
4 key top
5 aperture
4*a* raised portion of key top
6 semitone arrangement keyboard section
7 whole-tone arrangement keyboard section
8, 8*a* key top
9 ridge
10 ridge
11 transposition scale
12 minor-third arrangement keyboard section
13 diatessaron arrangement keyboard section
14 enclosure

BEST MODE 1 FOR CARRYING OUT THE INVENTION

FIG. 1 is a top plan view of a key substrate in accordance with the present invention.

A multiplicity of longitudinally extending rod-shaped key substrates 1 are disposed in an arc in plan such that tones generated by adjacent key substrates 1 have a difference of semitone.

Figure 2:
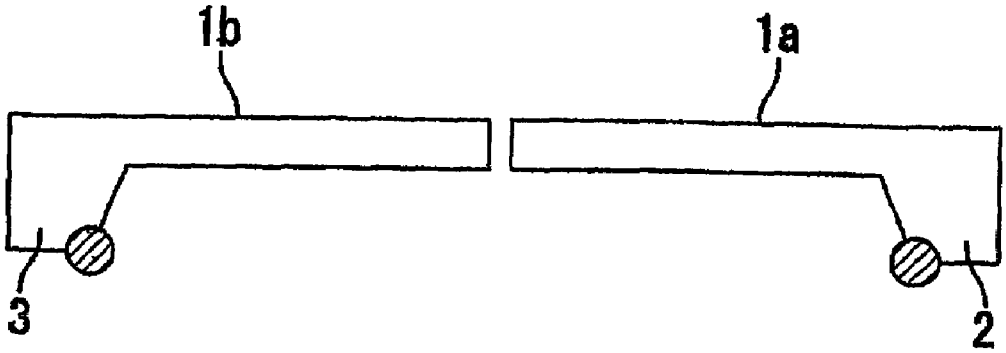
FIG. 2(A) is a front view of a key substrate of the same, which is divided into two parts.
FIG. 2(B) is an enlarged sectional view of the key substrate of the same.
Figure 2:
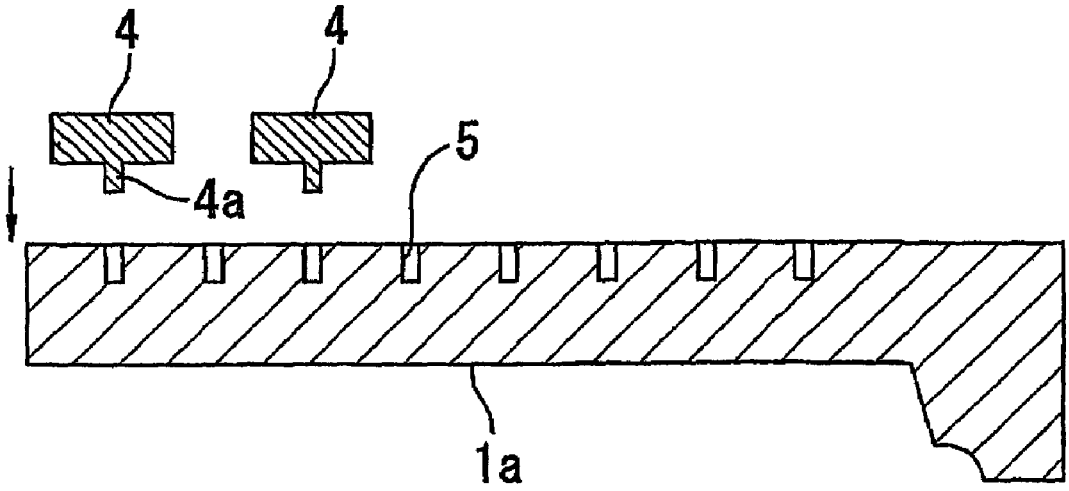

The key substrate 1 consists of a rear key substrate 1*a* located at its rear and a front key substrate 1*b* located at its front. The rear key substrate 1*a* is pivotally supported on a rear end 2 and the front key substrate 1*b* is pivotally supported on a front end (FIG. 2A). As a result, the amount of vertical displacement of the front key substrate 1*b* becomes smaller at the front where the keys may often be struck with, relatively short, the little finger or the thumb, whilst it becomes larger at the rear where the keys may often be struck with, relatively long, the forefinger, the middle finger, or the third finger, making the keyboard easy to play in conformity with the human engineering.

The top surface of the key substrate 1 has a plurality of apertures 5 each for mounting a key top 4 therein such that each of the aperture 5 receives a raised portion 4*a* formed on each key top 4 (FIG. 2B). If the same number of apertures 1 are provided at the same locations on all the key substrates, those apertures 1 will provide a highest degree of freedom in the disposition of the key tops. In cases where the array of the key tops are determined in advance, however, the apertures may be provided only at locations where the predetermined key tops are mounted.

It is to be noted that the mechanism for amounting the key tops is not limited to the apertures. For example, opposite to the above, the key substrate 1 may be provided with a raised portion adapted to be fitted in an aperture formed in the key top. Alternatively, the side surfaces of the key substrate 1 may be provided with grooves adapted to be clamped by a clip portion formed on the key top.

BEST MODE 2 FOR CARRYING OUT THE INVENTION

Figure 3:
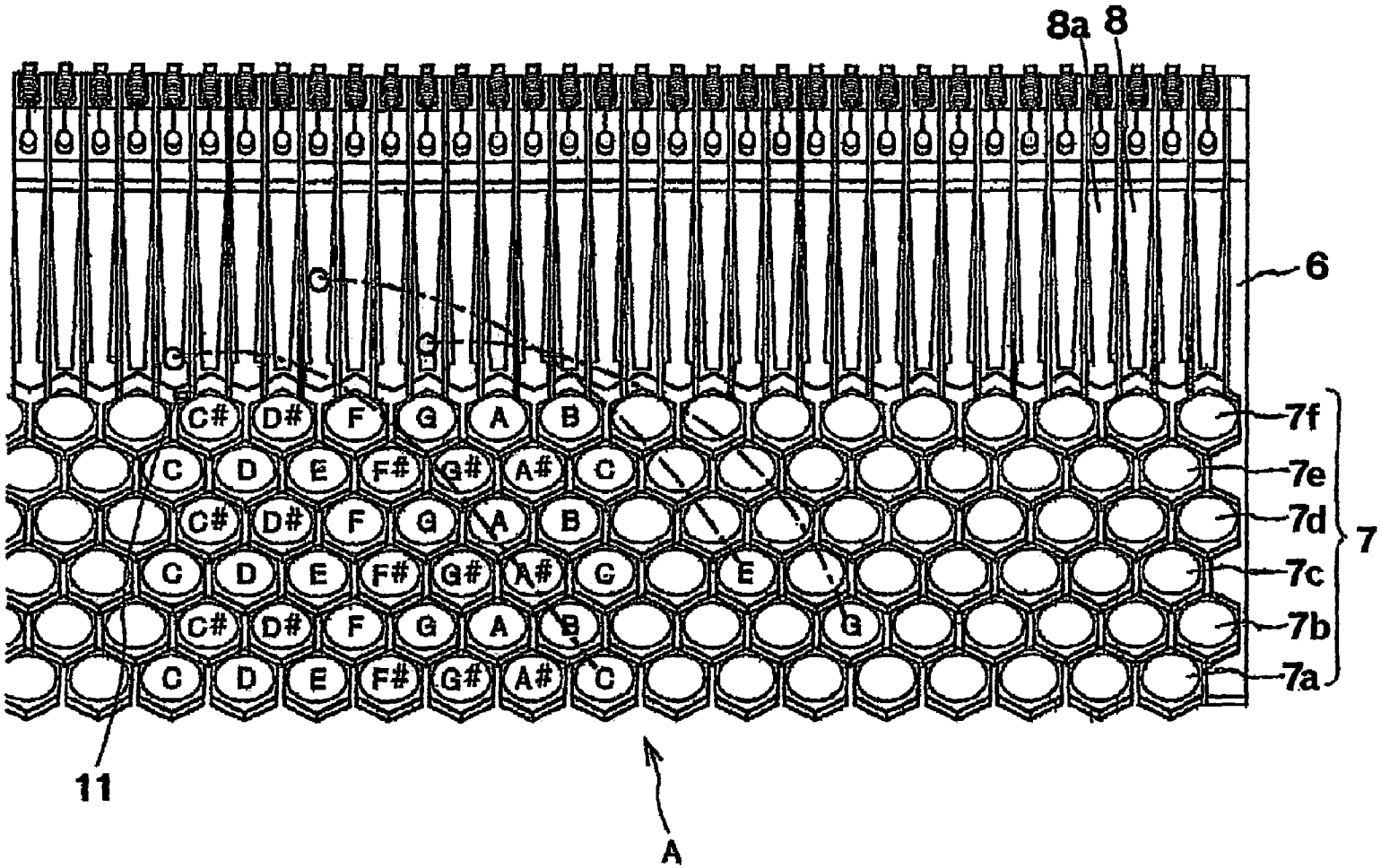
FIG. 3 is a top plan view of an embodiment 2 in accordance with the present invention.
Figure 4:
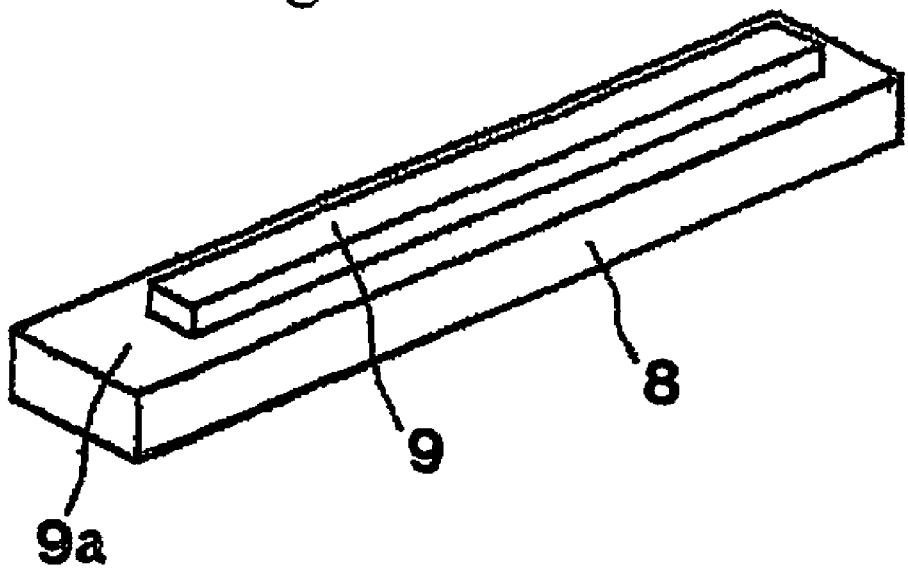
FIG. 4 is a perspective view of a key top of the same, provided with a raised portion.
Figure 5:
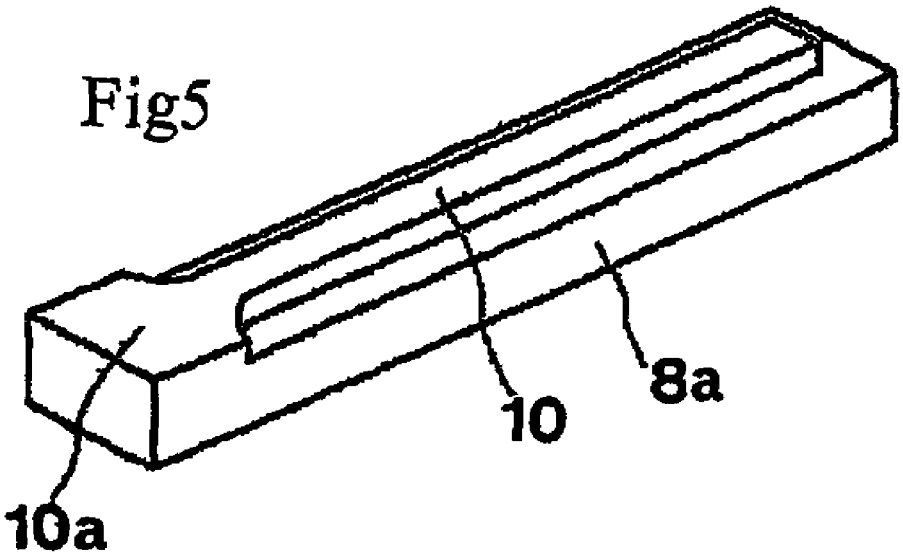
FIG. 5 is a perspective view of the key top of the same, provided with an enlarged portion.

FIGS. 3 to 5 are related to claims 3 and 4.

Referring to FIG. 3, a semitone arrangement keyboard section 6 and a whole-tone arrangement keyboard section 7 are disposed at the rear and front, respectively, of a keyboard A.

The semitone arrangement keyboard section 6 is generally rectangular and includes a multiplicity of, two types of key tops 8 and 8*a* which are alternately juxtaposed. The key tops 8 are disposed at locations where opposed key tops lie in the closest keyboard row of the whole-tone arrangement keyboard section 7, whilst the key tops 8*a* are disposed at locations where no opposed key tops lie in the closest keyboard row of the whole-tone arrangement keyboard section 7.

As regards the shape of the key tops, the key top 8 is formed with a longitudinally extending ridge 9 and with a ridge-free portion positioned at its extremity. The key top 8*a* is formed with a longitudinally extending ridge 10 and with an enlarged portion having a larger width positioned at its extremity.

The ridges 9 and 10 serve to provide engagement means for fingers, and their heights are preferably of the order of 3 millimeters.

The reason to form the ridge-free portion 9*a* at the extremity of the key top 8 is to allow fingers to strike the keys while smoothly sliding from the key top 8 to the enlarged portion 10*a* of the key top 8*a*. Similar effect could also be obtained by reducing the length of the key top 8 in lieu of forming the ridge-free portion.

The whole-tone arrangement keyboard section 7 includes six whole-tone arrangement rows 7*a*, 7*b*, 7*c*, 7*d*, 7*e* and 7*f* which are staggered with a shift equal to half of the key top width Herein, from the front side of the six whole-tone keyboard rows the first row 7*a*, third row 7*c* and fifth row 7*e* are keyboard rows having the same tone configuration whilst the second row 7*b*, fourth row 7*d* and sixth row 7*f* are keyboard rows having the same tone configuration, such that two keys closest to each other in front-to-rear adjacent keyboard rows have a difference of semitone.

In the diagram, reference numeral 11 denotes a transposition scale capable of laterally sliding to indicate the position of a specific tone, e.g., "do" in correspondence with the key of a tune to be played. This transposition scale may provide a indication in the form of light (e.g., by disposing light sources along the whole-tone keyboard rows). In such a case, different colors may be imparted to different tone names.

In the keyboard of this embodiment, when the fingers pressing three circled keys in the semitone arrangement keyboard section 6 of FIG. 3 are intactly slid as shown in chain-dotted lines (i.e., with chordal glissando as in guitar), the chord can be played with smooth sliding from the semitone arrangement keyboard section 6 to the whole-tone arrangement keyboard section 7.

In this event, due to the two types of shapes imparted to the key tops of the semitone arrangement keyboard section 6, the fingers naturally move diagonally downward without moving toward the direction where the key tops are absent, when moving from the semitone arrangement keyboard section 6 to the whole-tone arrangement keyboard section 7.

More specifically, of the keys belonging to the semitone arrangement keyboard section 6, the key tops 8 opposed to the keys of the whole-tone arrangement keyboard section 7 are each provided with the ridge 9 so that the fingers are prevented from moving to the whole-tone arrangement keyboard section by the engagement with the ridges. On the other hand, the key tops 8*a* out of opposition to the whole-tone arrangement keyboard section keys are each provided with the ridge 10 having at its extremity the enlarged portion 10*a* with a larger width, so that the fingers move smoothly through the enlarged portions to the whole-tone arrangement keyboard section 7.

BEST MODE 3 FOR CARRYING OUT THE INVENTION

Figure 6:
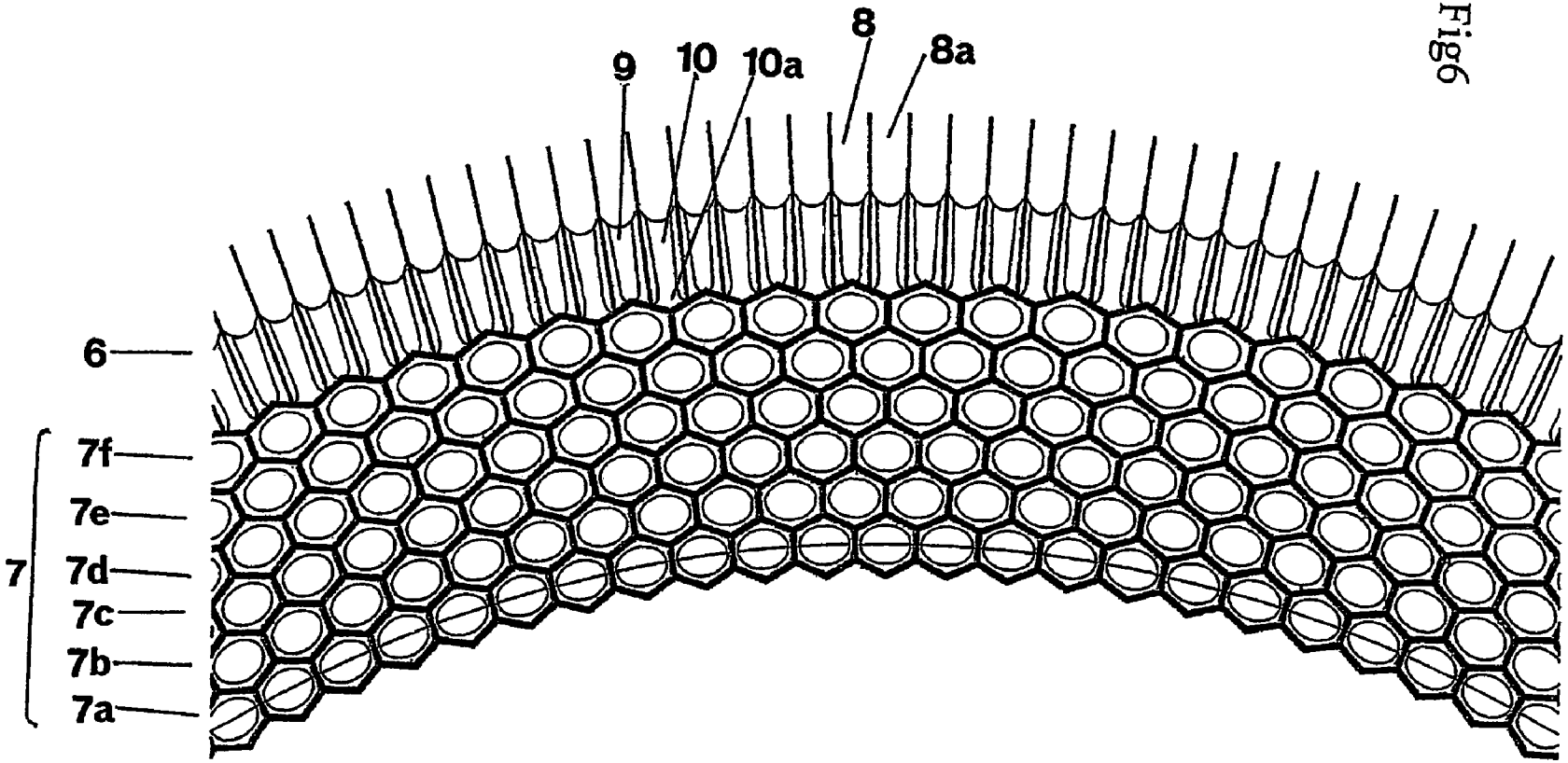
FIG. 6 is a top plan view of an embodiment 3 in accordance with the present invention.

FIG. 6 is related to the invention defined in claim 7.

Referring to FIG. 6, the semitone keyboard section 6 and the whole tone keyboard section 7 are disposed in an arc in plan to obtain a keyboard A, with the configurations of the keyboard sections 6 and 7 being the same as the above embodiment.

Of the keyboard rows making up the whole tone arrangement keyboard section 7 in this embodiment, the pitch of arrangement of key tops in a front-side keyboard row is smaller than the pitch of arrangement of key tops in a rear-side keyboard row. The keyboard of this invention allows all the tunes to be played, excepting glissando, by use of two or three keyboard rows of the whole tone arrangement keyboard section 7.

Thus, the player can select, for performance, any keyboard rows having pitches suited to, e.g., the dimensions of his/her hands (lengths of fingers).

Due to such an arcuate arrangement, the rectilinear distance between adjacent key tops becomes smaller than that in the parallel arrangement of the key tops as in the keyboard of FIG. 3 or the prior art. Therefore, the player can strike the keys of chords having a wider range, as compared with the case of using the keyboard with the linear arrangement, widening the range of tunes playable by any player having smaller hands.

The keyboard rows being positioned so as to surround the player, even when striking the keys at both the ends of the keyboard there is no need for the player to move his/her body laterally and to bend his/her wrists to unnatural angles, merely by rotating his/her arms around the elbows or shoulder. Thus, there is no risk to damage the player's wrists, enabling even the player having shorter arms to simultaneously strike the keys at high tones and low tones without any effort.

Since a rear keyboard row has wider key tops, the keys of the rear keyboard row are easy to strike when playing by use of two front-to-rear adjacent keyboard rows.

The key substrate may longitudinally be halved as described in the embodiment 1 such that its rear end provides a support for the key substrates in the semitone arrangement keyboard section 1 and that its front end provides a support for the key substrates in the whole-tone arrangement section 2. In consequence, the whole-tone arrangement keyboard section having a high frequency of use can present a smaller key striking depth at the front side (closer to the player) but a larger key striking depth at the rear side, allowing each part to have a key striking depth suited to the length of the fingers striking the keys, thus making possible to play a tune with movements in conformity with the ergonomics.

BEST MODE 4 FOR CARRYING OUT THE INVENTION

Figure 7:
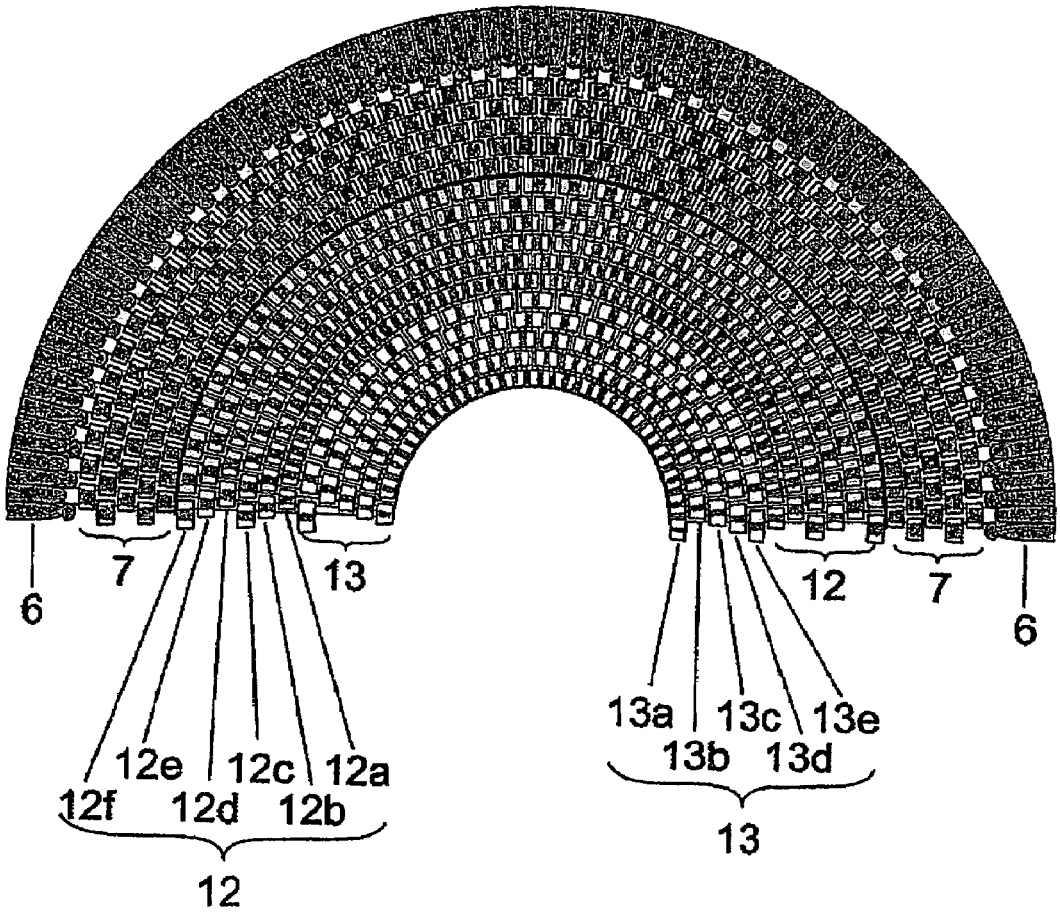
FIG. 7 is a top plan view of an embodiment 4 in accordance with the present invention.
Figure 8:
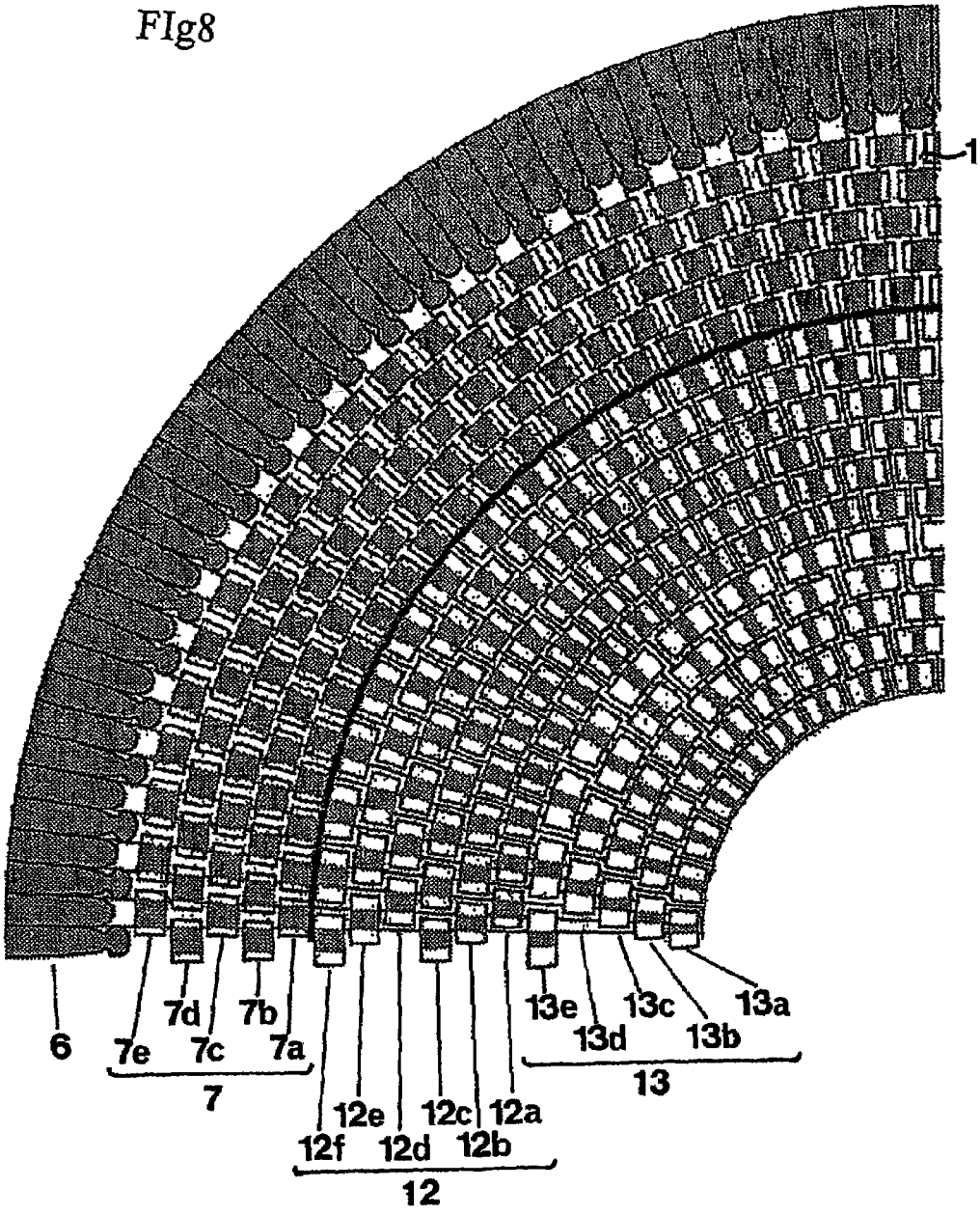
FIG. 8 is a partly enlarged top plan view of the same.

FIGS. 7 and 8 are related to the invention defined in claim 5. A keyboard A configured to be arcuate in plan comprises a rearmost, semitone arrangement keyboard section 6, a whole-tone arrangement keyboard section 7 in front of the keyboard section 6, a minor-third arrangement keyboard section 12 in front of the keyboard section 7, including six keyboard rows 12*a* to 12*f*, and a foremost, diatessaron arrangement keyboard section 13 including five keyboard rows 13*a* to 13*e*.

Adjacent keys in each of the keyboard rows making up the minor-third arrangement keyboard section 12 have a difference of minor third relative to each other, whereas keys in front-to-rear adjacent keyboard rows have a difference of whole tone from front toward diagonally right rear.

Each key top is mounted on the key substrate 1 at a meshed region of the diagrams.

Figure 9:
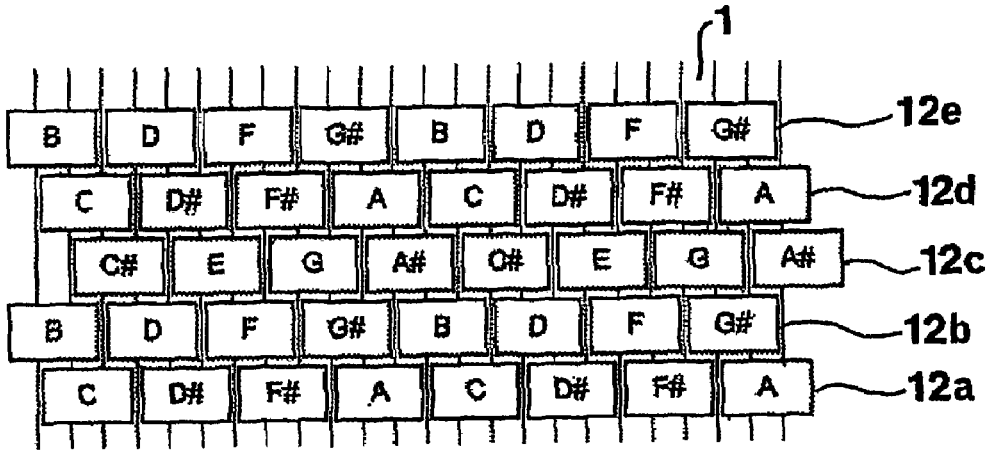
FIG. 9 is a diagram showing allocation of tones in a minor-third arrangement keyboard section.
Figure 10:
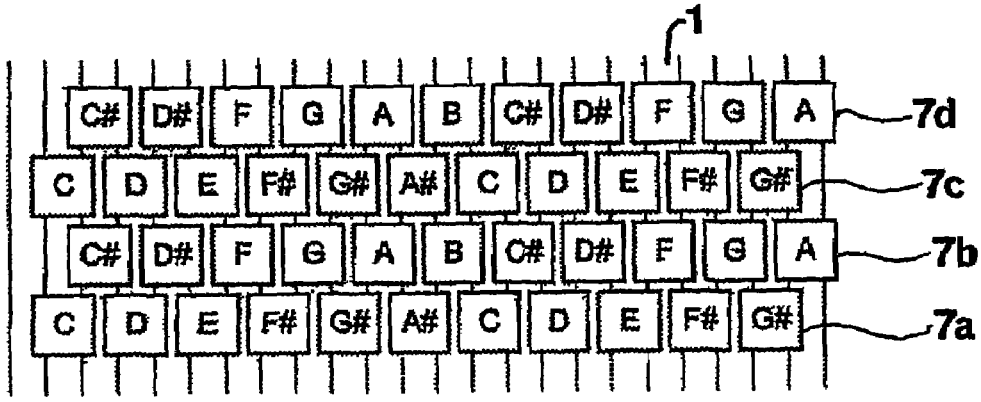
FIG. 10 is a diagram showing allocation of tones in a whole-tone arrangement keyboard section.

FIG. 9 illustrates allocation of tones to keys in the minor-third arrangement keyboard section 12. Tones of keys in the foremost keyboard row 12*a* are C, D#, F#, A, C, . . . from left in the mentioned order, tones of keys in the second keyboard row 12*b* are D, F, G#, B, D, . . . from left in the mentioned order, and tones of keys in the third keyboard row 12*c* are C#, E, G, A#, C#, . . . from left in the mentioned order.

Arrangement is such that tones of front-to-rear adjacent keys in front-to-rear adjacent keyboard rows have a difference of whole tone from front toward diagonally right rear. For example, the D key in the second keyboard row 12*b* is adjacent, diagonally rearward, to the C key in the keyboard row 12*a* in front of the keyboard row 12*b*, and the C# key in the third keyboard row 12*c* is situated diagonally rearward of the D key in the keyboard row 12*b* in front of the keyboard row 12*c*.

In the arrangement, the keyboard rows 12*d*, 12*e* and 12*f* are equal to the keyboard rows 12*a* 12*b* and 12*c*, respectively. Although at least three keyboard rows are indispensable to generate all the tones, provision of more than three keyboard rows will be optional.

Use of this keyboard ensures an extremely smooth execution of the same fingering as in the case of the ordinary keyboard. In cases where a scale in C major is played with the right hand using the ordinary keyboard, the C, D and E keys are in sequence struck with the thumb, the forefinger and middle finger, respectively, after which the thumb is again used to strike the F key. When executing such a fingering with the ordinary keyboard, the thumb needs to pass under the middle finger in order to strike the F key, making a smooth fingering difficult.

In the minor-third arrangement keyboard of FIG. 9, however, the F key is situated diagonally forward of the E key, so that the thumb can move effortlessly to the position of the F key without passing under the middle finger. This enables a tune with a quick tempo to be played relatively easily.

The whole-tone arrangement keyboard allows several key options when playing a scale. This may be advantageous to experts but pose a hesitation in fingering to beginners.

However, the minor-third scale allows only one key option, causing no hesitation in selecting the keys.

It is to be appreciated that the minor-third arrangement keyboard will further become easy to play by including on the order of ten keyboard rows.

Figure 11:
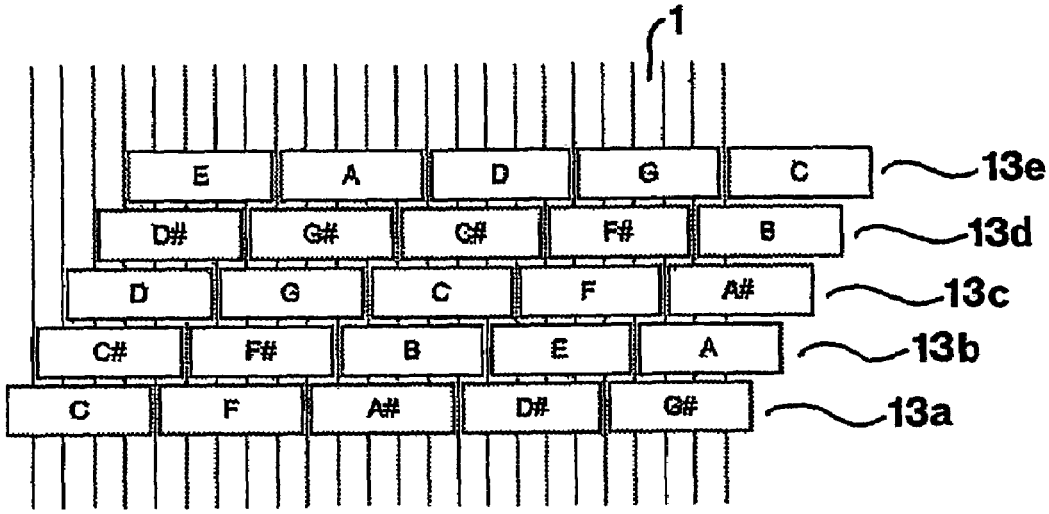
FIG. 11 is a diagram showing allocation of tones in a diatessaron arrangement keyboard section.

FIG. 11 illustrates allocation of tones to keys in the diatessaron arrangement keyboard section 13. Tones of keys in the foremost keyboard row 13*a* are C, F, A#, D#, G#, F, . . . from left in the mentioned order; tones of keys in the second keyboard row 13*b* are C#, F#, B, E, A, C#, . . . from left in the mentioned order; tones of keys in the third keyboard row 13*c* are D, G, C, F, A#, D, . . . from left in the mentioned order; tone of keys in the fourth keyboard row 13*d* are D#, G#, C#, F#, B, D#, . . . from left in the mentioned order; and tones of keys in the fifth keyboard row 13*e* are E, A, D, G, C, E, . . . from left in the mentioned order. Tones of adjacent keys in front-to-rear adjacent keyboard rows have a difference of semitone. For instance, the C# key in the second keyboard row 13*b* is adjacent, diagonally rearward, to the C key of the keyboard row 13*a* in front of the keyboard row 13*b*; the D key in the third keyboard row 13*c* is adjacent, diagonally rearward, to the C# key in the keyboard row 13*b* in front of the keyboard row 13*c*; the D# key in the fourth keyboard row 13*d* is adjacent, diagonally rearward, to the D key in the keyboard row 13*c* in front of the keyboard row 13*d*; and the E key in the fifth keyboard row 13*e* is adjacent, diagonally rearward, to the D# key in the keyboard row 13*d* in front of the keyboard row 13*e*.

In the arcuate in plan keyboard, the front side has an extremely small interval between laterally adjacent key substrates, thus making it difficult to mount the key tops in a whole-tone arrangement. Even though the key tops are mounted in the whole-tone arrangement, their surface areas will become extremely small, rendering them impractical.

However, by employing the keyboard rows with the minor-third arrangement or the diatessaron arrangement as described above, it will suffice to mount the key top every third key substrate in case of the minor third, and every fifth key substrate in case of the diatessaron, whereupon the key tops having a relatively wider surface area can be mounted even when the interval between adjacent key substrates is small thus making it possible to configure a practical keyboard within a limited zone. The keyboard rows can be of a major-third arrangement or any scale arrangement.

Figure 12:
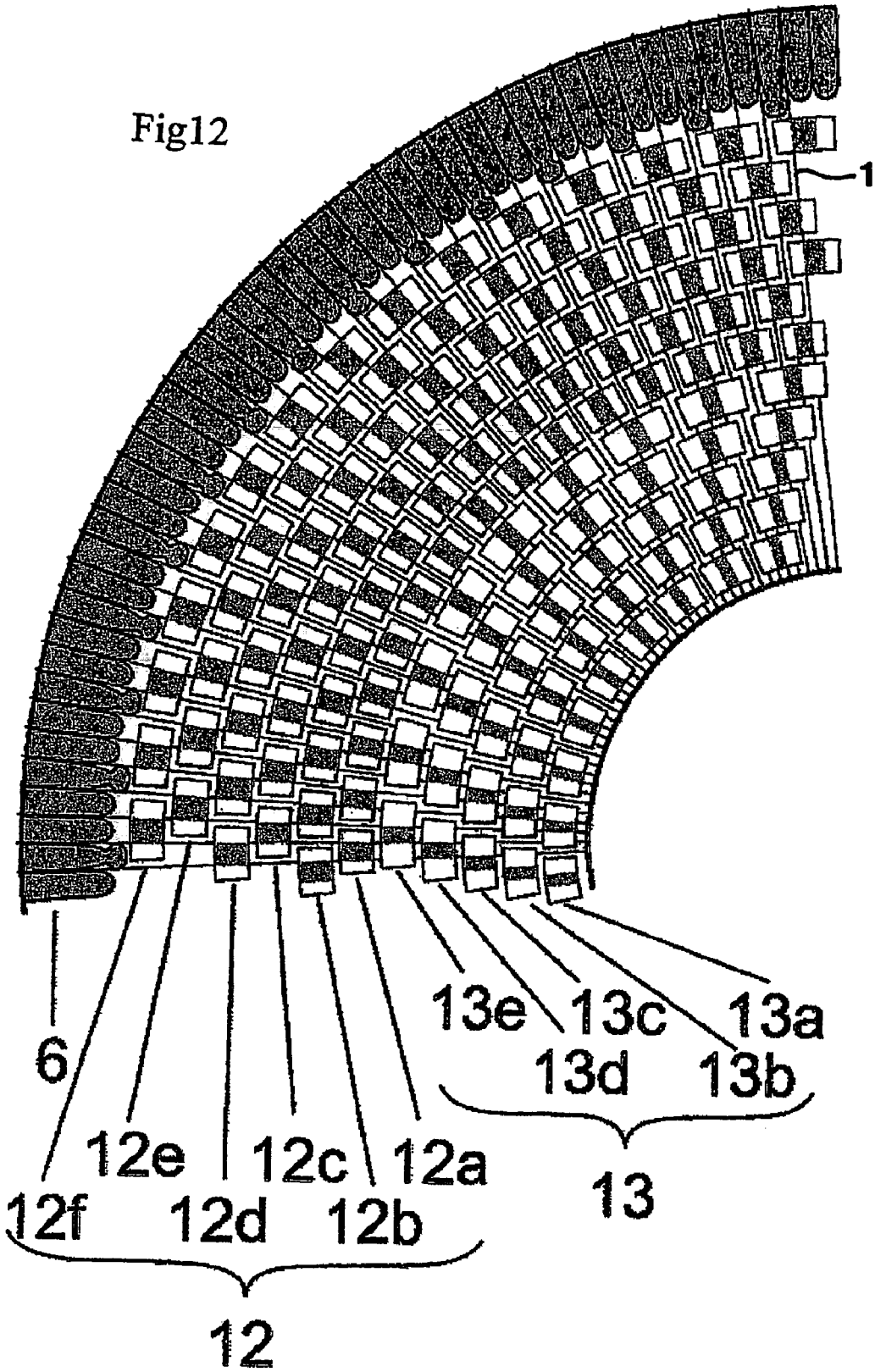
FIG. 12 is a top plan view showing another example of arrangement in the shape of an arc in plan.

FIG. 12 shows an arcuate in plan keyboard, which is configured by a semitone arrangement keyboard section 6, a minor-third arrangement keyboard section 12 and a diatessaron arrangement keyboard section 13.

The keyboard of this invention could be divided into two parts, i.e., a part for the right hand (for high tones) and a part for the left hand (for low tones). In this event, symmetrically with the keyboard for the right hand, tones are allocated to the keyboard for the left hand so that tunes can be played with the same fingering for the right and left hands.

More specifically, allocation of tones for keyboard for the right hand is carried out such that the tones become higher from left rightward toward right in the same manner as the prior art, whereas allocation of tones for the keyboard for the left hand is carried out such that the tones become higher from right leftward. Such allocation of tones enables do and sol to be struck with the thumb and the little finger, respectively, of both right and left hands, although do is conventionally struck with the right hand's thumb and the left hand's little finger but conversely sol is struck with the right hand's little finger and the left hand's thumb.

This makes the mastering of fingering extremely easy and impedes the occurrence of imbalance of tones between the low-tone part and the high-tone part, attributable to the difference of power between the thumb and the little finger.

By allocating tones of the low-tone part to the keys for the left hand symmetrically with tones of the high-tone part, it would also be possible for electronic instruments to change the allocation of tones by a switch with the keyboard remaining integrated.

BEST MODE 5 FOR CARRYING OUT THE INVENTION

Figure 13:
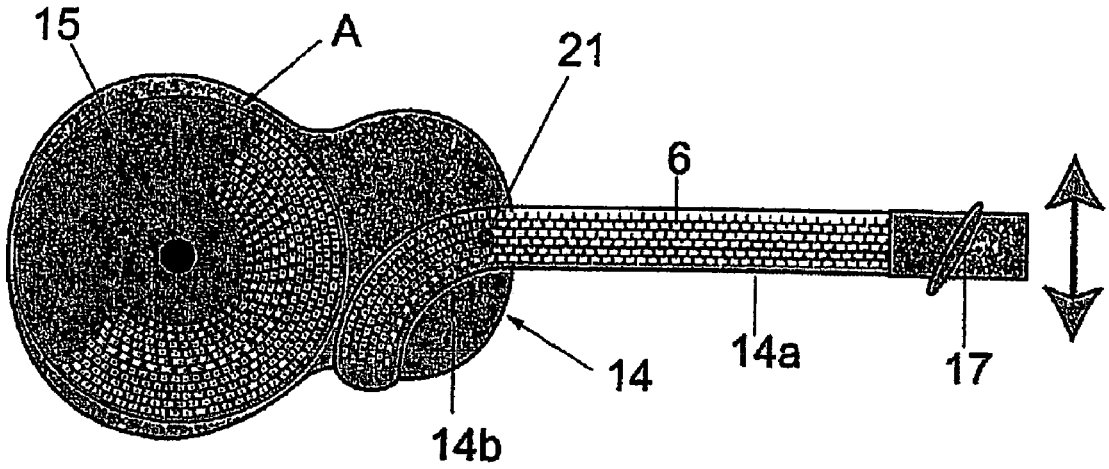
FIG. 13 is a front view of an embodiment 5 in accordance with the present invention.
Figure 14:
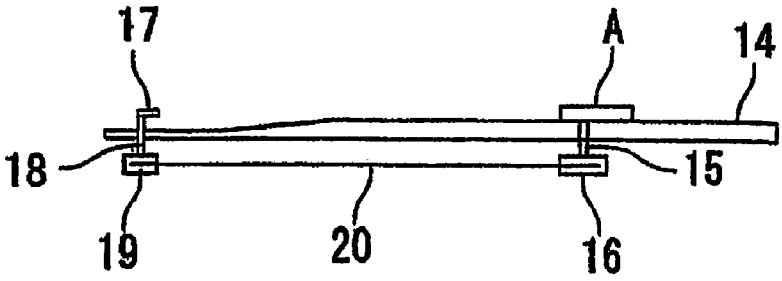
FIG. 14 is a diagram showing a keyboard rotation mechanism of the same.

FIG. 13 shows the keyboard of the present invention, mounted on an enclosure in the form of a guitar, the enclosure incorporating therein an electrically configured sound source.

The enclosure 14 comprises a neck 14*a* provided with a longitudinally extending, semitone arrangement keyboard section 6, and a body 14*b* mounted with an arcuate in plan keyboard A (as shown in FIG. 6 or 8 for example).

The keyboard A is rotatably mounted via a pivot 15 on the enclosure 14, the pivot 15 being fitted with a pulley 16. The neck 14*a* is mounted with a handle 17 which has a pivot 18 fitted with a pulley 19. A belt 19 is stretched between the pulley 19 and the pulley 16 so that rotation of the handle 17 causes rotation of the keyboard A.

Such a configuration allows keys intended to be struck by the player to register in position with the player's hands, whereby the player can play a wide range of tunes while keeping his/her palms (or fingers) at a certain direction.

An alternative way to rotate the keyboard is to rotatably couple the neck 14*a* and the body 14*b* together via a, pivot 21, instead of providing the lever 17, such that rotation of the neck 14*a* causes rotation of the keyboard A, or to dispose a pedal underfoot such that the pedal is interlocked with the keyboard via the belt and pulleys.

The keyboard having the configuration of FIG. 13 is applicable to a computer keyboard. More specifically, letter keys, symbol keys, numeric keys and function keys are disposed on the neck 14*a* and the body 14*b* at proper arrangement. A switch may be provided in order to make keys available to both a keyboard for musical instruments and a keyboard for computer input.

Such a configuration allows a standing input to the personal computer, and if a computer body comprised of a CPU, a hard disc, etc., is built into the enclosure 14, allows even a walking input to the personal computer.

INDUSTRIAL APPLICABILITY

According to the invention as defined in claim 1, a key substrate is provided with a plurality of key top mounting portions so that a key top is mounted on any mounting portion to thereby obtain a keyboard having a desired key arrangement.

According to the invention as defined in claim 2, there can be obtained a key which has a small vertical displacement at the front side, to thereby obviate any imbalance of sound volume arising from the difference in length of the fingers.

According to the invention as defined in claim 3, the semitone arrangement keyboard section is disposed at the rear of the keyboard, so that there can be played a series of consecutive tones with a difference of semitone by sliding the fingers in this semitone arrangement keyboard section. A series of consecutive tones with a difference of whole tone can also be played by laterally sliding the fingers in the whole-tone arrangement keyboard section. The fingers may be slid across the semitone arrangement keyboard section, and thereafter moved to the whole-tone arrangement keyboard section and slid diagonally forward so that a series of consecutive tones can be played with a difference of semitone.

According to the invention as defined in claim 4, the longitudinally extending raised portions formed on the key tops in the keyboard row with a difference of semitone prevent the fingers from migrating to the whole-tone arrangement keyboard section, allowing the fingers to move to the whole-tone arrangement keyboard section only through the enlarged protrusions formed at their extremities. Thus, when sliding from the keyboard row with a difference of semitone diagonally forward, the fingers can migrate smoothly to the key tops in the whole-tone arrangement keyboard section.

According to the invention as defined in claim 5, key tops having a wider surface area can be mounted in spite of reduced intervals between adjacent key substrates, and the performance can be done with the same fingering as in the ordinary keyboard.

According to the invention as defined in claim 6, the keyboard is arcuate so that the front-side keyboard rows have reduced pitches between adjacent key tops whereas the rear-side keyboard rows have increased pitches between the adjacent key tops. Thus, by selecting keyboard rows to be used depending on the lengths of the player's fingers, it is possible to use the keyboard rows having pitches suited to the player and, due to reduced rectilinear distances between adjacent key tops, to strike a wider range of chords as compared with the keyboard with the linear arrangement.

In this manner, the present invention is useful for keyboard instruments since it renders the keyboard of the keyboard instruments easier to play and makes a wider range of tunes easily playable even by players having small hands.

The invention claimed is:

1. A keyboard for musical instruments having a plurality of keyboard rows, said keyboard comprising:

a semitone arrangement keyboard section situated at a rear side of said keyboard; and a whole-tone arrangement keyboard section situated at a front end of said keyboard;

said whole-tone arrangement keyboard section including a plurality of whole-tone arrangement keyboard rows in each of which laterally adjacent keys generate tones with a difference of whole tone, said plurality of whole-tone arrangement keyboard rows being staggered such that front-to-rear adjacent keys generate tones with a difference of semitone, wherein each key making up a rearmost whole-tone arrangement keyboard row generates the same tone as generated by a key in opposition thereto of said semitone arrangement keyboard section, and wherein said semitone arrangement keyboard section includes rectangular key tops, with key tops in opposition to key tops of said whole-tone arrangement keyboard section being each formed with a raised portion which has substantially the same width in the longitudinal direction, with key tops out of opposition to key tops of said whole-tone arrangement keyboard section being each formed with a raised portion whose extremity is enlarged.

2. The keyboard for musical instruments according to claim 1, wherein said keys are disposed in an arc in plan.

* * * * *